US011959498B2

(12) United States Patent
Yazdi et al.

(10) Patent No.: US 11,959,498 B2
(45) Date of Patent: Apr. 16, 2024

(54) PRESSURE EXCHANGER INSERTS

(71) Applicant: Energy Recovery, Inc., San Leandro, CA (US)

(72) Inventors: Behzad Zamanian Yazdi, San Francisco, CA (US); Farshad Ghasripoor, Berkeley, CA (US); Kuo-Chiang Chen, Dublin, CA (US); Patrick Morphew, Houston, TX (US); James Elliott McLean, Jr., Houston, TX (US)

(73) Assignee: Energy Recovery, Inc., San Leandro, CA (US)

( * ) Notice: Subject to any disclaimer, the term of this patent is extended or adjusted under 35 U.S.C. 154(b) by 135 days.

(21) Appl. No.: 17/506,423

(22) Filed: Oct. 20, 2021

(65) Prior Publication Data

US 2023/0119452 A1 Apr. 20, 2023

(51) Int. Cl.
*F04F 13/00* (2009.01)

(52) U.S. Cl.
CPC ..... *F04F 13/00* (2013.01)

(58) Field of Classification Search
CPC ..... F04F 13/00
USPC ..... 415/182.1
See application file for complete search history.

(56) References Cited

U.S. PATENT DOCUMENTS 8,555,655 B2 * 10/2013 Benz ..... F01D 9/023 60/800
9,556,736 B2 * 1/2017 Sigurdsson ..... F04B 9/117
10,359,075 B2 * 7/2019 Anderson ..... E21B 43/26
10,933,375 B1 * 3/2021 Oklejas, Jr. ..... B01D 61/10
11,274,681 B2 * 3/2022 Boyko ..... F15B 3/00
2011/0176936 A1 7/2011 Andrews
2011/0203791 A1 * 8/2011 Jin ..... E21B 17/042 166/244.1
2016/0039054 A1 2/2016 Ghasripoor et al.
2019/0055805 A1 2/2019 Lewis et al.
2021/0277917 A1 9/2021 Ghasripoor et al.

FOREIGN PATENT DOCUMENTS

DE 202014103030 U1 * 8/2014 ..... F15B 15/2892
EP 798472 B1 * 8/2001 ..... F15B 15/12

OTHER PUBLICATIONS

Machine translation of DE-202014103030-U1 retrieved from FIT database/ (Year: 2014).*

(Continued)

*Primary Examiner* — Woody A Lee, Jr.
*Assistant Examiner* — Justin A Pruitt
(74) *Attorney, Agent, or Firm* — Lowenstein Sandler LLP

(57) ABSTRACT

A system includes an isobaric pressure exchanger (IPX) configured to exchange pressure between a first fluid and a second fluid. The IPX includes a rotor configured to rotate about a longitudinal axis of the rotor. The rotor forms rotor ports arranged substantially symmetrically around the longitudinal axis at a distal end of the rotor. The IPX further includes an end cover configured to be disposed at the first distal end of the rotor. The end cover forms end cover ports. The rotor ports are arranged for hydraulic communication with the end cover ports. The IPX further includes an insert disposed between two of the rotor ports or between two of the end cover ports.

20 Claims, 9 Drawing Sheets

(56) References Cited

OTHER PUBLICATIONS

Machine translation of EP-798472-B1 retrieved from FIT database. (Year: 2001).*
International Search Report and Written Opinion received for PCT Application No. PCT/US2022/046901, dated Jan. 24, 2023.

* cited by examiner

PRESSURE EXCHANGER INSERTS

TECHNICAL FIELD

The present disclosure relates to pressure exchangers, and, more particularly, pressure exchanger inserts.

BACKGROUND

Pressure exchangers exchange pressure between a first liquid and a second liquid. A pressure exchanger may include one or more moving parts (e.g., rotor, etc.). Due to movement of parts, high pressure of fluid, solid particles in one or more of the fluids, etc., components of pressure exchangers become worn down and lose efficiency over time.

BRIEF DESCRIPTION OF THE DRAWINGS

The present disclosure is illustrated by way of example, and not by way of limitation in the figures of the accompanying drawings.

DETAILED DESCRIPTION OF EMBODIMENTS

Figure 1A:
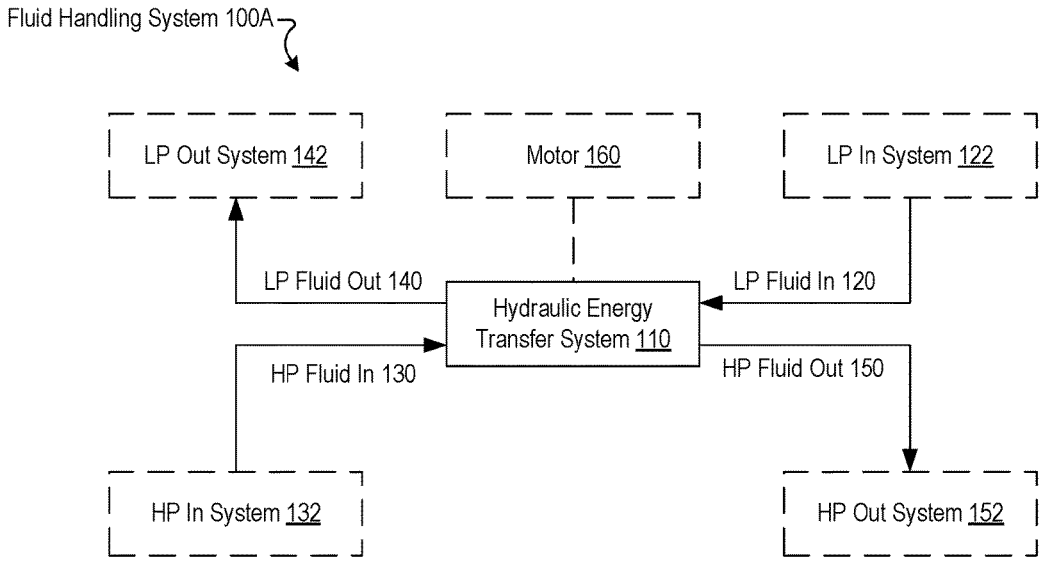
FIGS. 1A-D illustrate schematic diagrams of fluid handling systems including hydraulic energy transfer systems, according to certain embodiments.

Embodiments described herein are related to pressure exchanger inserts.

High pressure fluid may be used by systems, such as hydraulic fracturing (e.g., fracking or fracing) systems, desalinization systems, refrigeration systems, mud pumping systems, etc. Pumps may be used to provide the high pressure fluid. Solid particles (e.g., sand, powder, debris, ceramics, etc.) may damage and reduce efficiency of pumps. A pressure exchanger may be used to exchange pressure between two fluids. A pump may be used to increase the pressure of a first fluid that is substantially solid particle free (e.g., water). A pressure exchanger may receive the high pressure first fluid (e.g., water) and a low pressure second fluid (e.g., fluid containing solid particles) and may transfer the pressure from the high pressure first fluid to the low pressure second fluid.

Conventionally, components in pressure exchangers get worn down and become less efficient. A pressure exchanger may include a rotor and end covers (e.g., end plates). An end cover may interface with each distal end of the rotor. The rotor may rotate while the end covers remain stationary. As fluids (e.g., a fluid containing solid particles) flow through the end covers and the rotor, the end covers and rotor undergo abrasion and erosion (e.g., suspended solids in process fluids penetrate the sealing gaps inside the pressure exchanger). Erosion and/or abrasion in a pressure exchanger reduces life of the pressure exchanger, reduces efficiency, increases leakage, increases torque to spin the rotor of the pressure exchanger, increases mixing through axial gaps, reduces bearing load capacity and stiffness, etc. Erosion and/or abrasion in a pressure exchanger also increases service intervals of the pressure exchanger which increases time, replacement parts, downtime of systems, reduced yield (e.g., of desalinization, fracing, refrigeration), etc.

In some conventional systems, filtration systems are added before fluid enters the pressure exchanger to remove suspended abrasive particles from the fluid. The filtration systems use extra equipment, maintenance, time, and energy. Even with filtration systems, pressure exchangers can still undergo abrasion and erosion.

The devices, systems, and methods disclosed herein provide pressure exchanger inserts. A system may include a pressure exchanger (e.g., isobaric pressure exchanger (IPX), rotary IPX) that is configured to exchange pressure between a first fluid and a second fluid. The pressure exchanger may include a rotor, an end cover (e.g., end plate), and one or more inserts. The rotor may be configured to rotate about a longitudinal axis of the rotor. The rotor may form rotor ports arranged substantially symmetrically around the longitudinal axis at a distal end (e.g., face surface) of the rotor. The end cover may be configured to be disposed at the distal end of the rotor. The end cover may form end cover ports (e.g., inlet port and outlet port). The rotor ports may be arranged for hydraulic communication with the end cover ports. The end cover may be stationary while the rotor rotates. A first fluid may enter the inlet port of the end cover and then enter ports of the rotor. A second fluid may exit ports of the rotor and then exit the exit port of the end cover. The rotor rotates to transfer the pressure between the first fluid and the second fluid.

An insert is disposed between two of the rotor ports and/or between two of the ports of the end cover. The insert may be disposed at a location that undergoes greater amounts of wear (e.g., abrasion, erosion). Trial runs of the pressure exchanger and/or a model (e.g., computational fluid dynamic (CFD) model) may be used to determine the locations of greater amounts of wear. In the CFD model, velocity of the fluid can be calculated at different locations on the rotor and/or end cover.

The distal end of the rotor and a face surface of the end cover are disposed adjacent to each other (e.g., seal against to each other, interface with each other). The distal end of the rotor and/or the face surface of the end cover forms a recess and the insert is disposed in the recess. In some embodiments, the insert is a more durable material (e.g., with a hardness greater than about 97 HRA (Rockwell scale A)) than the rotor and/or end cover to resist abrasion and erosion. For example, the insert may be one or more of tungsten carbide, titanium, polycrystalline diamond (PCD), PCD disposed on a carbide substrate, etc. In some embodiments, the insert is a less durable material (e.g., with a hardness of about 25 HRA to about 30 HRA) (e.g., sacrificial material) than the rotor and/or end cover. For example, the insert may be stainless steel, aluminum, ceramic, etc.

The present disclosure has advantages over conventional solutions. The pressure exchanger of the present disclosure has one or more inserts that resist erosion and abrasion of the pressure exchanger which results in maintaining high efficiency of the pressure exchanger over time, overall reliability of the pressure exchanger, and service life of the pressure exchanger. This also decreases time, decreases frequency of replacement parts, decreases downtime of systems, and increases yield (e.g., of desalinization, fracing, refrigeration), etc. The inserts of the present disclosure can decrease amount of filtration to be performed of a fluid prior to the fluid entering the pressure exchanger.

Although some embodiments of the present disclosure are described in relation to the rotor and end cover of pressure exchangers, inserts of the current disclosure can be applied to other components and other devices.

Although some embodiments of the present disclosure are described in relation to isobaric pressure exchangers, pressure exchangers, and hydraulic energy transfer systems, the current disclosure can be applied to other systems and devices (e.g., pressure exchanger that is not isobaric, rotating components that are not a pressure exchanger, a pressure exchanger that is not rotary, etc.).

Although some embodiments of the present disclosure are described in relation to exchanging pressure between fluid used in fracing systems, desalinization systems, and/or refrigeration systems, the present disclosure can be applied to other types of systems. Fluids can refer to liquid, gas, transcritical fluid, supercritical fluid, subcritical fluid, and/or combinations thereof.

FIG. 1A illustrates a schematic diagram of a fluid handling system 100A including a hydraulic energy transfer system 110, according to certain embodiments.

In some embodiments, a hydraulic energy transfer system 110 includes a pressure exchanger (e.g., IPX). The hydraulic energy transfer system 110 (e.g., IPX) receives low pressure (LP) fluid in 120 (e.g., low-pressure inlet stream) from a LP in system 122. The hydraulic energy transfer system 110 also receives high pressure (HP) fluid in 130 (e.g., high-pressure inlet stream) from HP in system 132. The hydraulic energy transfer system 110 (e.g., IPX) exchanges pressure between the HP fluid in 130 and the LP fluid in 120 to provide LP fluid out 140 (e.g., low-pressure outlet stream) to LP fluid out system 142 and to provide HP fluid out 150 (e.g., high-pressure outlet stream) to HP fluid out system 152.

In some embodiments, the hydraulic energy transfer system 110 includes an IPX to exchange pressure between the HP fluid in 130 and the LP fluid in 120. The IPX may be a device that transfers fluid pressure between HP fluid in 130 and LP fluid in 120 at efficiencies in excess of approximately 50%, 60%, 70%, 80%, 90%, or greater (e.g., without utilizing centrifugal technology). High pressure (e.g., HP fluid in 130, HP fluid out 150) refers to pressures greater than the low pressure (e.g., LP fluid in 120, LP fluid out 140). LP fluid in 120 of the IPX may be pressurized and exit the IPX at high pressure (e.g., HP fluid out 150, at a pressure greater than that of LP fluid in 120), and HP fluid in 130 may be depressurized and exit the IPX at low pressure (e.g., LP fluid out 140, at a pressure less than that of the HP fluid in 130). The IPX may operate with the HP fluid in 130 directly applying a force to pressurize the LP fluid in 120, with or without a fluid separator between the fluids. Examples of fluid separators that may be used with the IPX include, but are not limited to, pistons, bladders, diaphragms and the like. In some embodiments, IPXs may be rotary devices. Rotary IPXs, such as those manufactured by Energy Recovery, Inc. of San Leandro, Calif., may not have any separate valves, since the effective valving action is accomplished internal to the device via the relative motion of a rotor with respect to end covers. Rotary IPXs may be designed to operate with internal pistons to isolate fluids and transfer pressure with relatively little mixing of the inlet fluid streams. Reciprocating IPXs may include a piston moving back and forth in a cylinder for transferring pressure between the fluid streams. Any IPX or multiple IPXs may be used in the present disclosure, such as, but not limited to, rotary IPXs, reciprocating IPXs, or any combination thereof. In addition, the IPX may be disposed on a skid separate from the other components of a fluid handling system 100 (e.g., in situations in which the IPX is added to an existing fluid handling system).

In some embodiments, a motor 160 is coupled to hydraulic energy transfer system 110 (e.g., to an IPX). In some embodiments, the motor 160 controls the speed of a rotor of the hydraulic energy transfer system 110 (e.g., to increase pressure of HP fluid out 150, to decrease pressure of HP fluid out 150, etc.). In some embodiments, motor 160 generates energy (e.g., acts as a generator) based on pressure exchanging in hydraulic energy transfer system 110.

The hydraulic energy transfer system 110 may be a hydraulic protection system (e.g., hydraulic buffer system, hydraulic isolation system) that may block or limit contact between solid particle laden fluid (e.g., frac fluid) and various equipment (e.g., hydraulic fracturing equipment, high-pressure pumps) while exchanging work and/or pressure with another fluid. By blocking or limiting contact between various equipment (e.g., fracturing equipment) and solid particle containing fluid, the hydraulic energy transfer system 110 increases the life and performance, while reducing abrasion and wear, of various equipment (e.g., fracturing equipment, high pressure fluid pumps). Less expensive equipment may be used in the fluid handling system 100 by using equipment (e.g., high pressure fluid pumps) not designed for abrasive fluids (e.g., frac fluids and/or corrosive fluids).

The hydraulic energy transfer system 110 may include a hydraulic turbocharger or hydraulic pressure exchange system, such as a rotating IPX. The IPX may include one or more chambers (e.g., 1 to 100) to facilitate pressure transfer and equalization of pressures between volumes of first and second fluids (e.g., gas, liquid, multi-phase fluid). In some embodiments, the IPX may transfer pressure between a first fluid (e.g., pressure exchange fluid, such as a proppant free or substantially proppant free fluid) and a second fluid that may be highly viscous and/or contain solid particles (e.g., frac fluid containing sand, proppant, powders, debris, ceramics). The solid particle fluid causes abrasion and/or erosion of components of the IPX, such as the rotor and end covers of the IPX. The fluid (e.g., abrasive particles in the fluid) may cause wear to an interface between the rotor and each end cover as the rotor rotates relative to the end covers. Replacing worn components of the IPX may be costly.

The IPX includes one or more inserts between rotor ports of the rotor and/or between end cover ports of the end cover. In some embodiments, the inserts may resist erosion and/or abrasion. In some embodiments, the inserts may be replaceable.

The hydraulic energy transfer system 110 may be used in different types of systems, such as fracing systems, desalination systems, refrigeration systems, etc.

Figure 1B:
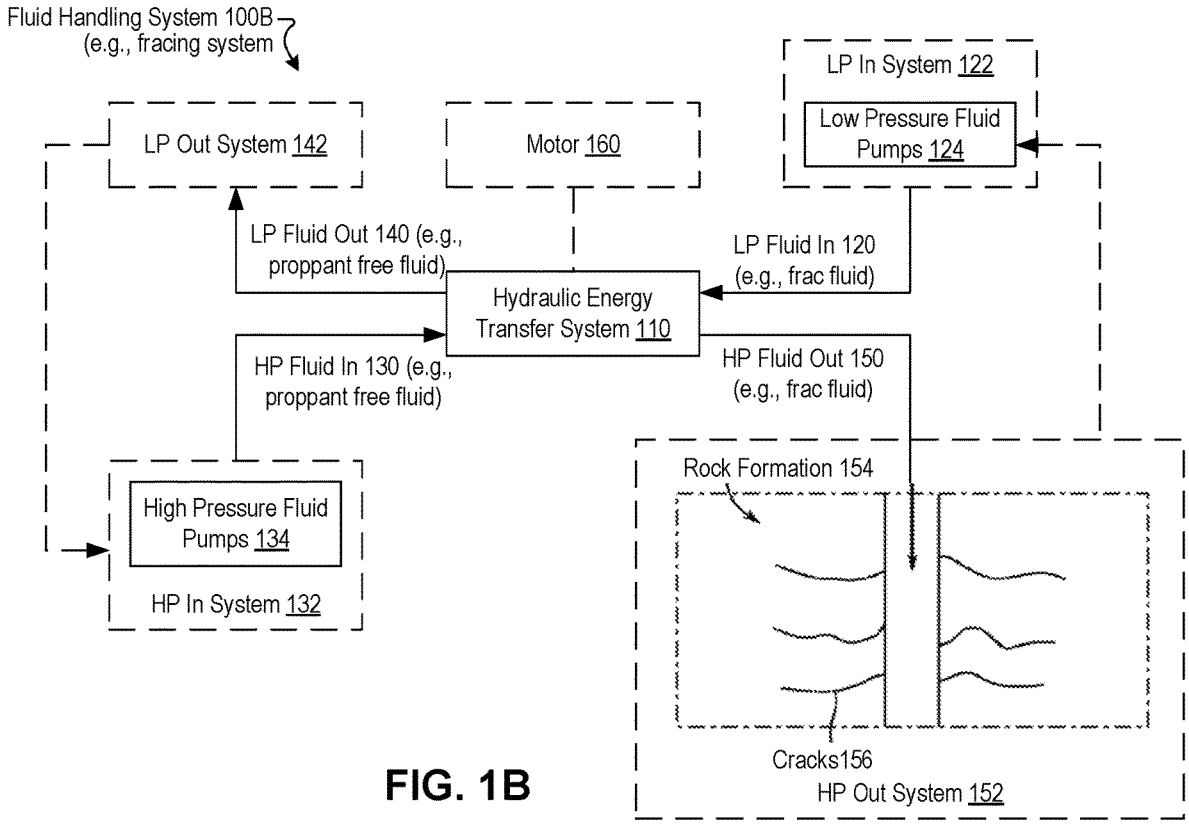

FIG. 1B illustrates a schematic diagram of a fluid handling system 100B including a hydraulic energy transfer system 110, according to certain embodiments. Fluid handling system 100B may be a fracing system. In some embodiments, fluid handling system 100B includes more components, less components, same routing, different routing, and/or the like than that shown in FIG. 1B.

LP fluid in 120 and HP fluid out 150 may be frac fluid (e.g., fluid including solid particles, proppant fluid, etc.). HP fluid in 130 and LP fluid out 140 may be substantially solid particle free fluid (e.g., proppant free fluid, water, filtered fluid, etc.).

LP in system 122 may include one or more low pressure fluid pumps to provide LP fluid in 120 to the hydraulic energy transfer system 110 (e.g., IPX). HP in system 132 may include one or more high pressure fluid pumps 134 to provide HP fluid in 130 to hydraulic energy transfer system 110.

Hydraulic energy transfer system 110 exchanges pressure between LP fluid in 120 (e.g., low pressure frac fluid) and HP fluid in 130 (e.g., high pressure water) to provide HP fluid out 150 (e.g., high pressure frac fluid) to HP out system 152 and to provide LP fluid out 140 (e.g., low pressure water). HP out system 152 may include a rock formation 154 (e.g., well) that includes cracks 156. The solid particles (e.g., proppants) from HP fluid out 150 may be provided into the cracks 156 of the rock formation.

In some embodiments, LP fluid out 140, high pressure fluid pumps 134, and HP fluid in 130 are part of a first loop (e.g., proppant free fluid loop). The LP fluid out 140 may be provided to the high pressure fluid pumps to generate HP fluid in 130 that becomes LP fluid out 140 upon exiting the hydraulic energy transfer system 110.

In some embodiments, LP fluid in 120, HP fluid out 150, and low pressure fluid pumps 124 are part of a second loop (e.g., proppant containing fluid loop). The HP fluid out 150 may be provided into the rock formation 154 and then pumped from the rock formation 154 by the low pressure fluid pumps 124 to generate LP fluid in 120.

In some embodiments, fluid handling system 100B is used in well completion operations in the oil and gas industry to perform hydraulic fracturing (e.g., fracking, fracing) to increase the release of oil and gas in rock formations 154. HP out system 152 may include rock formations 154 (e.g., a well). Hydraulic fracturing may include pumping HP fluid out 150 containing a combination of water, chemicals, and solid particles (e.g., sand, ceramics, proppant) into a well (e.g., rock formation 154) at high pressures. LP fluid in 120 and HP fluid out 150 may include a particulate laden fluid that increases the release of oil and gas in rock formations 154 by propagating and increasing the size of cracks 156 in the rock formations 154. The high pressures of HP fluid out 150 initiates and increases size of cracks 156 and propagation through the rock formation 154 to release more oil and gas, while the solid particles (e.g., powders, debris, etc.) enter the cracks 156 to keep the cracks 156 open (e.g., prevent the cracks 156 from closing once HP fluid out 150 is depressurized).

In order to pump this particulate laden fluid into the rock formation 154 (e.g., a well), the fluid handling system 100B may include one or more high pressure fluid pumps 134 and one or more low pressure fluid pumps 124 coupled to the hydraulic energy transfer system 110. For example, the hydraulic energy transfer system 110 may be a hydraulic turbocharger or an IPX (e.g., a rotary IPX). In operation, the hydraulic energy transfer system 110 transfers pressures without any substantial mixing between a first fluid (e.g., HP fluid in 130, proppant free fluid) pumped by the high pressure fluid pumps 134 and a second fluid (e.g., LP fluid in 120, proppant containing fluid, frac fluid) pumped by the low pressure fluid pumps 124. In this manner, the hydraulic energy transfer system 110 blocks or limits wear on the high pressure fluid pumps 134, while enabling the fluid handling system 100B to pump a high-pressure frac fluid (e.g., HP fluid out 150) into the rock formation 154 to release oil and gas. In order to operate in corrosive and abrasive environments, the hydraulic energy transfer system 110 may be made from materials resistant to corrosive and abrasive substances in either the first and second fluids. For example, the hydraulic energy transfer system 110 may be made out of ceramics (e.g., alumina, cermets, such as carbide, oxide, nitride, or boride hard phases) within a metal matrix (e.g., Co, Cr or Ni or any combination thereof) such as tungsten carbide in a matrix of CoCr, Ni, NiCr or Co.

In some embodiments, the hydraulic energy transfer system 110 includes an IPX (e.g., rotary IPX) and HP fluid in 130 (e.g., the first fluid, high-pressure solid particle free fluid) enters a first side of the IPX where the HP fluid in 130 contacts LP fluid in 120 (e.g., the second fluid, low-pressure frac fluid) entering the IPX on a second side. The contact between the fluids enables the HP fluid in 130 to increase the pressure of the second fluid (e.g., LP fluid in 120), which drives the second fluid out (e.g., HP fluid out 150) of the IPX and down a well (e.g., rock formation 154) for fracturing operations. The first fluid (e.g., LP fluid out 140) similarly exits the IPX, but at a low pressure after exchanging pressure with the second fluid. As noted above, the second fluid may be a low-pressure frac fluid that may include abrasive particles, which may wear the interface between the rotor and the respective end covers as the rotor rotates relative to the respective end covers.

The IPX of hydraulic energy transfer system 110 in fluid handling system 100B includes one or more inserts between rotor ports of the rotor and/or between end cover ports of the end cover. In some embodiments, the inserts may resist erosion and/or abrasion. In some embodiments, the inserts may be replaceable. The inserts may prevent abrasion and/or erosion from fluids with solid particles (e.g., frac fluid, proppant fluid), corrosive fluids, high pressure fluids, and/or the like.

Figure 1C:
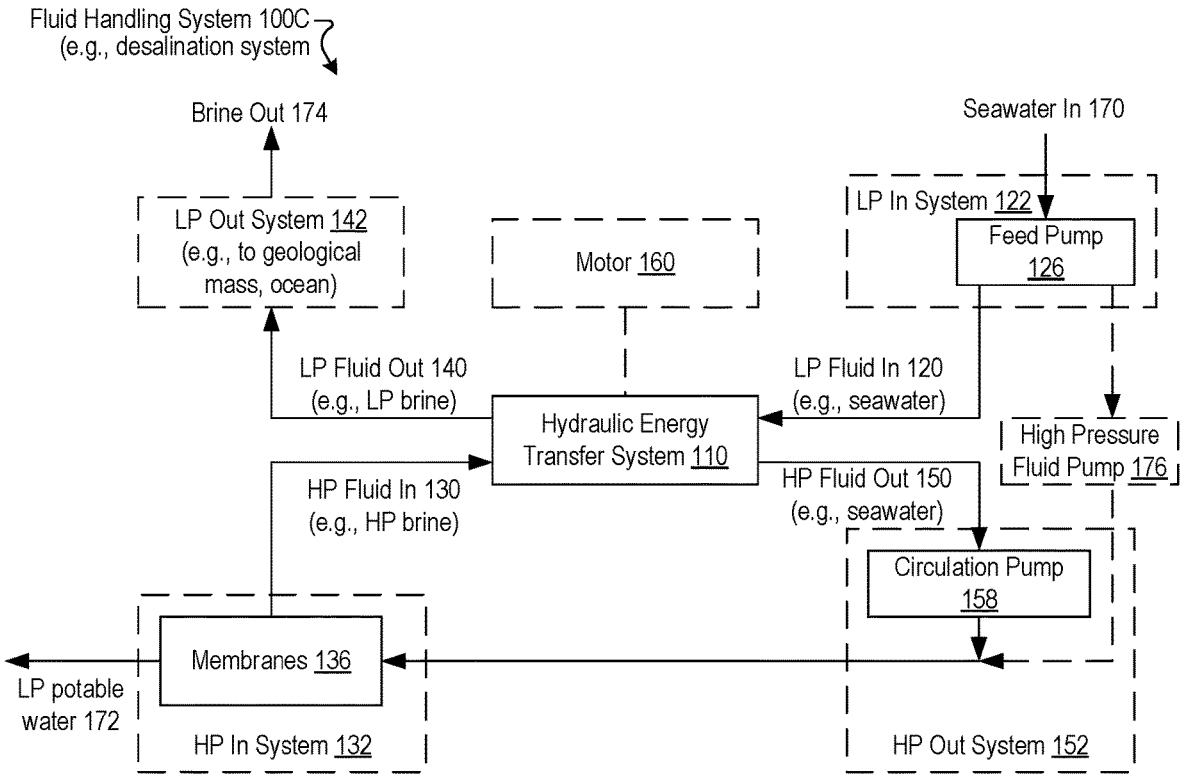

FIG. 1C illustrates a schematic diagram of a fluid handling system 100C including a hydraulic energy transfer system 110, according to certain embodiments. Fluid handling system 100C may be a desalination system (e.g., remove salt and/or other minerals from water). In some embodiments, fluid handling system 100C includes more components, less components, same routing, different routing, and/or the like than that shown in FIG. 1C.

LP in system 122 may include a feed pump 126 (e.g., low pressure fluid pump 124) that receives seawater in 170 (e.g., feed water from a reservoir or directly from the ocean) and provides LP fluid in 120 (e.g., low pressure seawater, feed water) to hydraulic energy transfer system 110 (e.g., IPX). HP in system 132 may include membranes 136 that provide HP fluid in 130 (e.g., high pressure brine) to hydraulic energy transfer system 110 (e.g., IPX). The hydraulic energy transfer system 110 exchanges pressure between the HP fluid in 130 and LP fluid in 120 to provide HP fluid out 150 (e.g., high pressure seawater) to HP out system 152 and to provide LP fluid out 140 (e.g., low pressure brine) to LP out system 142 (e.g., geological mass, ocean, sea, discarded, etc.).

The membranes 136 may be a membrane separation device configured to separate fluids traversing a membrane, such as a reverse osmosis membrane. Membranes 136 may provide HP fluid in 130 which is a concentrated feed-water or concentrate (e.g., brine) to the hydraulic energy transfer system 110. Pressure of the HP fluid in 130 may be used to compress low-pressure feed water (e.g., LP fluid in 120) to be high pressure feed water (e.g., HP fluid out 150). For simplicity and illustration purposes, the term feed water is used. However, fluids other than water may be used in the hydraulic energy transfer system 110.

The circulation pump 158 (e.g., turbine) provides the HP fluid out 150 (e.g., high pressure seawater) to membranes 136. The membranes 136 filter the HP fluid out 150 to provide LP potable water 172 and HP fluid in 130 (e.g., high pressure brine). The LP out system 142 provides brine out 174 (e.g., to geological mass, ocean, sea, discarded, etc.).

In some embodiments, a high pressure fluid pump 176 is disposed between the feed pump 126 and the membranes 136. The high pressure fluid pump 176 increases pressure of the low pressure seawater (e.g., LP fluid in 120, provides high pressure feed water) to be mixed with the high pressure seawater provided by circulation pump 158.

In some embodiments, use of the hydraulic energy transfer system 110 decreases the load on high pressure fluid pump 176. In some embodiments, fluid handling system 100C provides LP potable water 172 without use of high pressure fluid pump 176. In some embodiments, fluid handling system 100C provides LP potable water 172 with intermittent use of high pressure fluid pump 176.

In some examples, hydraulic energy transfer system 110 (e.g., IPX) receives LP fluid in 120 (e.g., low-pressure feed-water) at about 30 pounds per square inch (PSI) and receives HP fluid in 130 (e.g., high-pressure brine or concentrate) at about 980 PSI. The hydraulic energy transfer system 110 (e.g., IPX) transfers pressure from the high-pressure concentrate (e.g., HP fluid in 130) to the low-pressure feed-water (e.g., LP fluid in 120). The hydraulic energy transfer system 110 (e.g., IPX) outputs HP fluid out 150 (e.g., high pressure (compressed) feed-water) at about 965 PSI and LP fluid out 140 (e.g., low-pressure concentrate) at about 15 PSI. Thus, the hydraulic energy transfer system 110 (e.g., IPX) may be about 97% efficient since the input volume is about equal to the output volume of the hydraulic energy transfer system 110 (e.g., IPX), and 965 PSI is about 97% of 980 PSI.

The IPX of hydraulic energy transfer system 110 in fluid handling system 100C includes one or more inserts between rotor ports of the rotor and/or between end cover ports of the end cover. In some embodiments, the inserts may resist erosion and/or abrasion. In some embodiments, the inserts may be replaceable. The inserts may prevent abrasion and/or erosion from fluids with solid particles (e.g., brine, seawater, etc.), corrosive fluids, high pressure fluids, and/or the like.

Figure 1D:
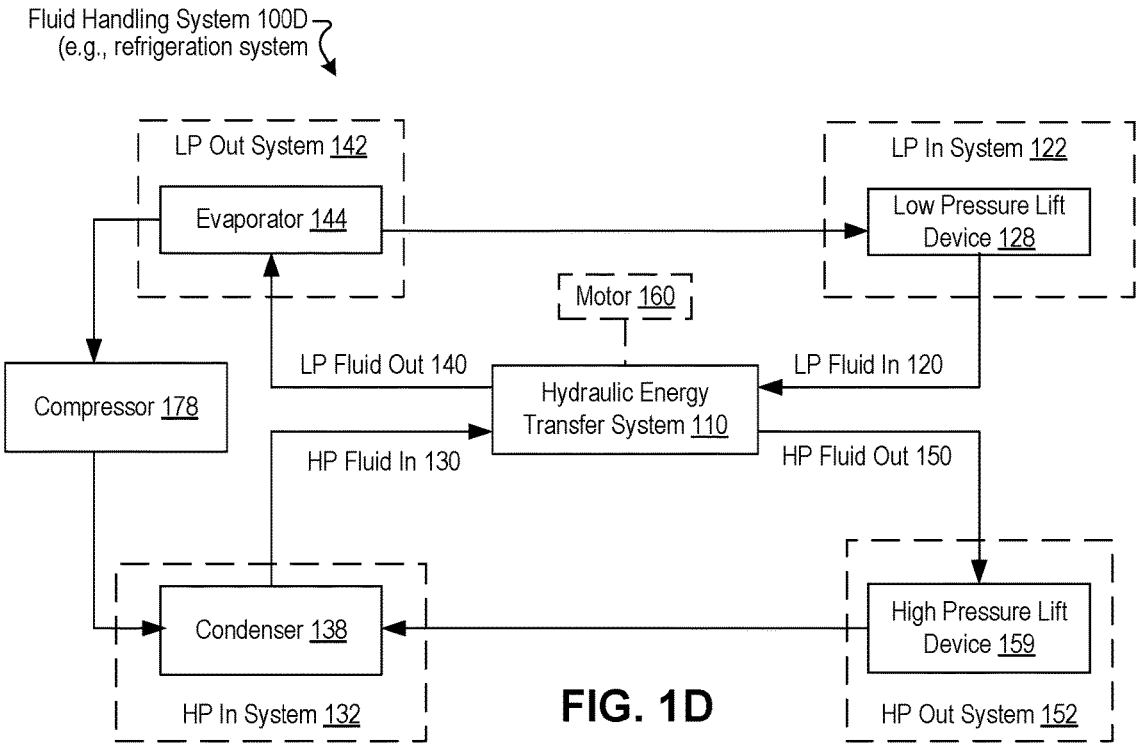

FIG. 1D illustrates a schematic diagram of a fluid handling system 100D including a hydraulic energy transfer system 110, according to certain embodiments. Fluid handling system 100D may be a refrigeration system. In some embodiments, fluid handling system 100D includes more components, less components, same routing, different routing, and/or the like than that shown in FIG. 1D.

Hydraulic energy transfer system 110 (e.g., IPX) may receive LP fluid in 120 from LP in system 122 (e.g., low pressure lift device 128, low pressure fluid pump, etc.) and HP fluid in 130 from HP in system 132 (e.g., condenser 138). The hydraulic energy transfer system 110 (e.g., IPX) may exchange pressure between the LP fluid in 120 and HP fluid in 130 to provide HP fluid out 150 to HP out system 152 (e.g., high pressure lift device 159) and to provide LP fluid out 140 to LP out system 142 (e.g., evaporator 144). The evaporator 144 may provide the fluid to compressor 178 and low pressure lift device 128. The condenser 138 may receive fluid from compressor 178 and high pressure lift device 159.

The fluid handling system 100D may be a closed system. LP fluid in 120, HP fluid in 130, LP fluid out 140, and HP fluid out 150 may all be a fluid (e.g., refrigerant) that is circulated in the closed system of fluid handling system 100D.

In some embodiments, the fluid of fluid handling system 100D may include solid particles. For example, the piping, equipment, connections (e.g., pipe welds, pipe soldering), etc. may introduce solid particles (e.g., solid particles from the welds) into the fluid in the fluid handling system 100D. The solid particles in the fluid and/or the high pressure of the fluid may cause abrasion and/or erosion of components (e.g., rotor, end covers) of the IPX of hydraulic energy transfer system 110.

The IPX of hydraulic energy transfer system 110 in fluid handling system 100D includes one or more inserts between rotor ports of the rotor and/or between end cover ports of the end cover. In some embodiments, the inserts may resist erosion and/or abrasion. In some embodiments, the inserts may be replaceable. The inserts may prevent abrasion and/or erosion from fluids with solid particles (e.g., particles from the piping welds, etc.), corrosive fluids, high pressure fluids, and/or the like.

FIGS. 2A-2E are exploded perspective views a rotary IPX 40 (e.g., rotary pressure exchanger, rotary liquid piston compressor (LPC)), according to certain embodiments.

The rotary IPX 40 of FIGS. 2A-E includes one or more inserts between rotor ports (e.g., openings 72 and/or openings 74) of the rotor 46 and/or between end cover ports (e.g., inlet and outlet apertures 76, 78, 80, and/or 82) of the end covers 64, 66. In some embodiments, the inserts may resist erosion and/or abrasion. In some embodiments, the inserts may be replaceable.

IPX 40 is configured to transfer pressure and/or work between a first fluid (e.g., proppant free fluid or supercritical carbon dioxide, HP fluid in 130) and a second fluid (e.g., frac fluid or superheated gaseous carbon dioxide, LP fluid in 120) with minimal mixing of the fluids. The rotary IPX 40 may include a generally cylindrical body portion 42 that includes a sleeve 44 (e.g., rotor sleeve) and a rotor 46. The rotary IPX 40 may also include two end caps 48 and 50 that include manifolds 52 and 54, respectively. Manifold 52 includes respective inlet port 56 and outlet port 58, while manifold 54 includes respective inlet port 60 and outlet port 62. In operation, these inlet ports 56, 60 enable the first and second fluids to enter the rotary IPX 40 to exchange pressure, while the outlet ports 58, 62 enable the first and second fluids to then exit the rotary IPX 40. In operation, the inlet port 56 may receive a high-pressure first fluid (e.g., HP fluid in 130), and after exchanging pressure, the outlet port 58 may be used to route a low-pressure first fluid (e.g., LP fluid out 140) out of the rotary IPX 40. Similarly, the inlet port 60 may receive a low-pressure second fluid (e.g., LP fluid in 120) and the outlet port 62 may be used to route a high-pressure second fluid (e.g., HP fluid out 150) out of the rotary IPX 40. The end caps 48 and 50 include respective end covers 64 and 66 (e.g., end plates) disposed within respective manifolds 52 and 54 that enable fluid sealing contact with the rotor 46.

As noted above, one or more components of the IPX 40, such as the rotor 46, the end cover 64, and/or the end cover 66, may be constructed from a wear-resistant material (e.g., carbide, cemented carbide, silicon carbide, tungsten carbide, etc.) with a hardness greater than a predetermined threshold (e.g., a Vickers hardness number that is at least 1000, 1250, 1500, 1750, 2000, 2250, or more). For example, tungsten carbide may be more durable and may provide improved wear resistance to abrasive fluids as compared to other materials, such as alumina ceramics. Additionally, in some embodiments, one or more components of the IPX 40, such as the rotor 46, the end cover 64, the end cover 66, and/or other sealing surfaces of the IPX 40, may include an insert. In some embodiments, the inserts may be constructed from one or more wear-resistant materials (e.g., carbide, cemented carbide, silicon carbide, tungsten carbide, etc.) with a hardness greater than a predetermined threshold (e.g., a Vickers hardness number that is at least 1000, 1250, 1500, 1750, 2000, 2250, or more) to provide improved wear resistance.

The rotor 46 may be cylindrical and disposed in the sleeve 44, which enables the rotor 46 to rotate about the axis 68. The rotor 46 may have a plurality of channels 70 (e.g., ducts, rotor ducts) extending substantially longitudinally through the rotor 46 with openings 72 and 74 (e.g., rotor ports) at each end arranged symmetrically about the longitudinal axis 68. The openings 72 and 74 of the rotor 46 are arranged for hydraulic communication with inlet and outlet apertures 76 and 78 (e.g., end cover inlet port and end cover outlet port) and 80 and 82 (e.g., end cover inlet port and end cover outlet port) in the end covers 64 and 66, in such a manner that during rotation the channels 70 are exposed to fluid at high-pressure and fluid at low-pressure. As illustrated, the inlet and outlet apertures 76 and 78 and 80 and 82 may be designed in the form of arcs or segments of a circle (e.g., C-shaped).

In some embodiments, a controller using sensor feedback (e.g., revolutions per minute measured through a tachometer or optical encoder or volume flow rate measured through flowmeter) may control the extent of mixing between the first and second fluids in the rotary IPX 40, which may be used to improve the operability of the fluid handling system (e.g., fluid handling systems 100A-D of FIGS. 1A-D). For example, varying the volume flow rates of the first and second fluids entering the rotary IPX 40 allows the plant operator (e.g., system operator) to control the amount of fluid mixing within the IPX 40. In addition, varying the rotational speed of the rotor 46 also allows the operator to control mixing. Three characteristics of the rotary IPX 40 that affect mixing are: (1) the aspect ratio of the rotor channels 70; (2) the duration of exposure between the first and second fluids; and (3) the creation of a fluid barrier (e.g., an interface) between the first and second fluids within the rotor channels 70. First, the rotor channels 70 (e.g., ducts) are generally long and narrow, which stabilizes the flow within the rotary IPX 40. In addition, the first and second fluids may move through the channels 70 in a plug flow regime with minimal axial mixing. Second, in certain embodiments, the speed of the rotor 46 reduces contact between the first and second fluids. For example, the speed of the rotor 46 (e.g., rotor speed of approximately 1200 RPM) may reduce contact times between the first and second fluids to less than approximately 0.15 seconds, 0.10 seconds, or 0.05 seconds. Third, a small portion of the rotor channel 70 is used for the exchange of pressure between the first and second fluids. Therefore, a volume of fluid remains in the channel 70 as a barrier between the first and second fluids. All these mechanisms may limit mixing within the rotary IPX 40. Moreover, in some embodiments, the rotary IPX 40 may be designed to operate with internal pistons or other barriers, either complete or partial, that isolate the first and second fluids while enabling pressure transfer.

FIGS. 2B-2E are exploded views of an embodiment of the rotary IPX 40 illustrating the sequence of positions of a single rotor channel 70 in the rotor 46 as the channel 70 rotates through a complete cycle. It is noted that FIGS. 2B-2E are simplifications of the rotary IPX 40 showing one rotor channel 70, and the channel 70 is shown as having a circular cross-sectional shape. In other embodiments, the rotary IPX 40 may include a plurality of channels 70 with the same or different cross-sectional shapes (e.g., circular, oval, square, rectangular, polygonal, etc.). Thus, FIGS. 2B-2E are simplifications for purposes of illustration, and other embodiments of the rotary IPX 40 may have configurations different from that shown in FIGS. 2A-2E. As described in detail below, the rotary IPX 40 facilitates pressure exchange between first and second fluids by enabling the first and second fluids to briefly contact each other within the rotor 46. In certain embodiments, this exchange happens at speeds that result in limited mixing of the first and second fluids. The speed of the pressure wave traveling through the rotor channel 70 (as soon as the channel is exposed to the aperture 76), the diffusion speeds of the fluids, and the rotational speed of rotor 46 dictate whether any mixing occurs and to what extent.

Figure 2A:
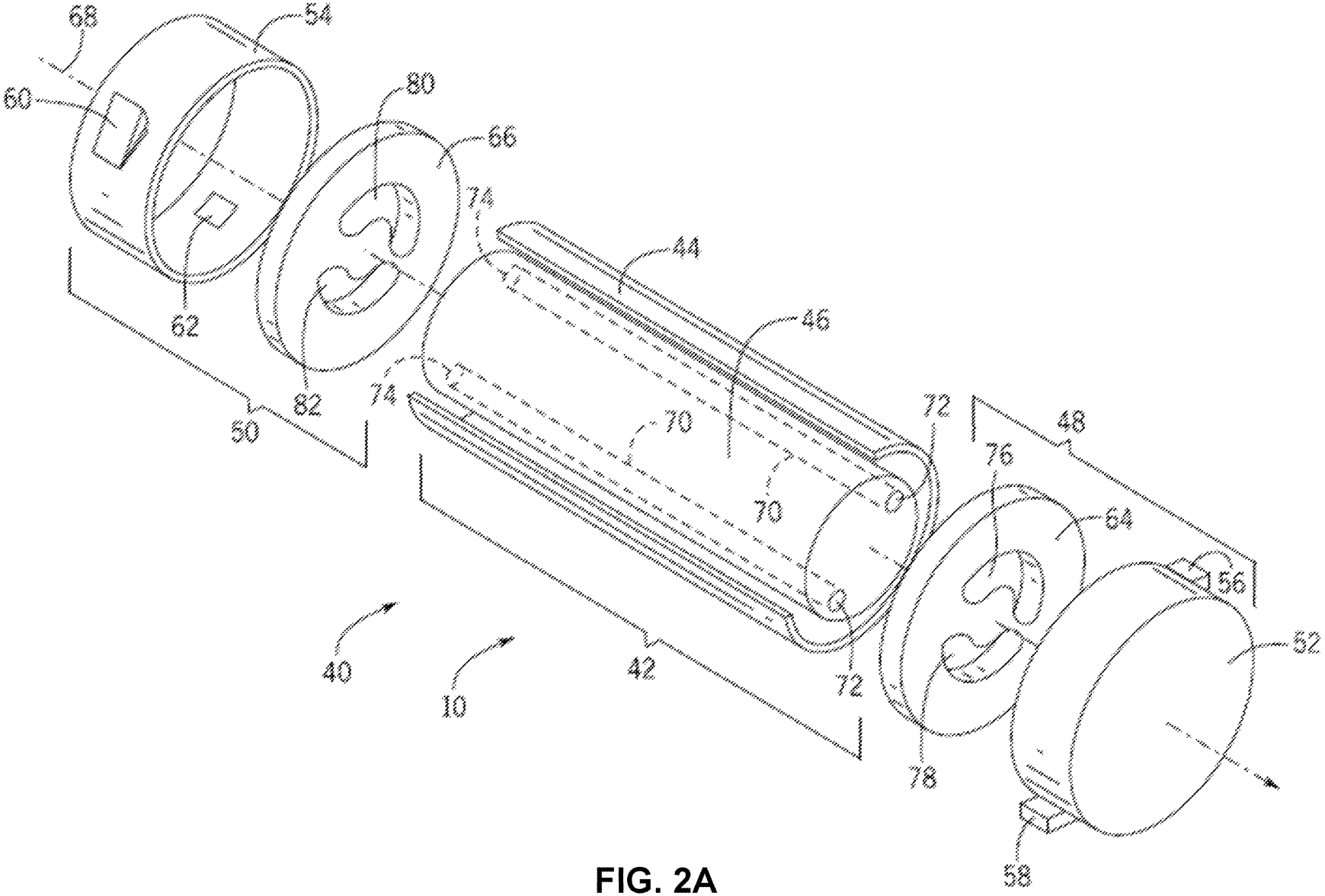
FIGS. 2A-E are exploded perspective views an isobaric pressure exchanger (IPX), according to certain embodiments.
Figure 2D:
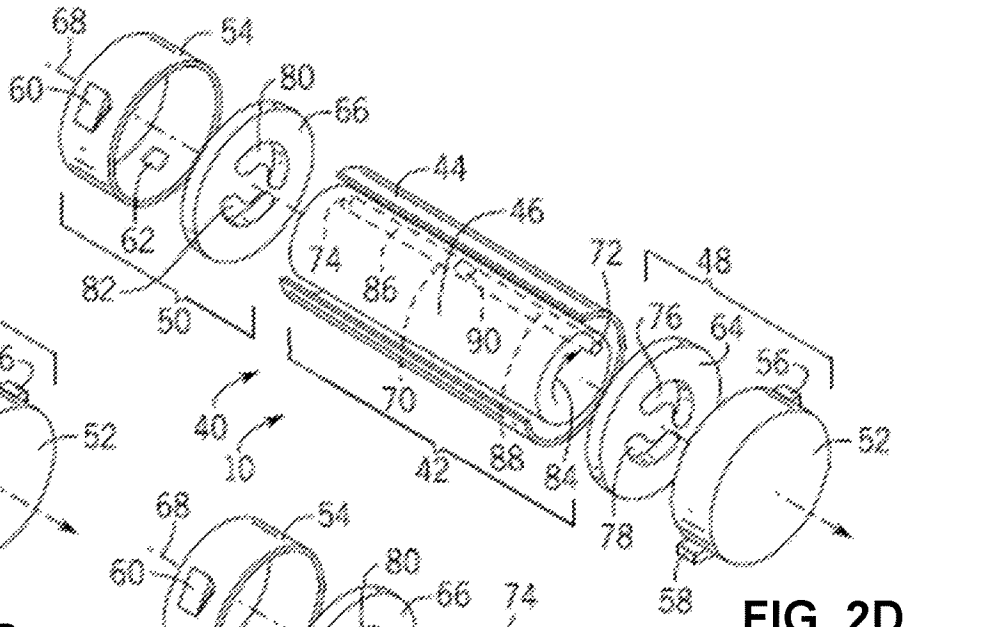
Figure 2E:
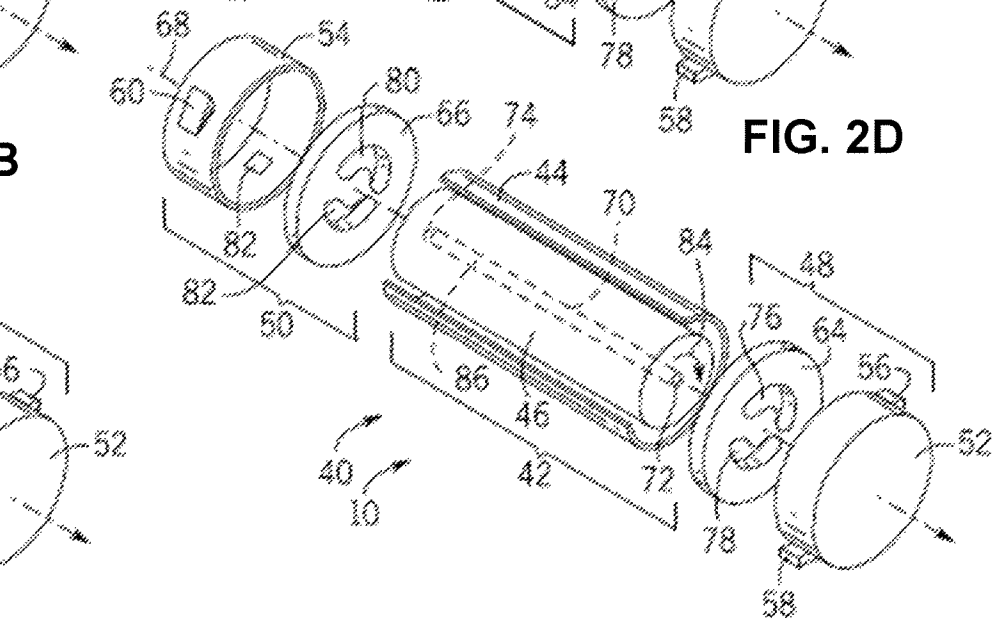
Figure 2B:
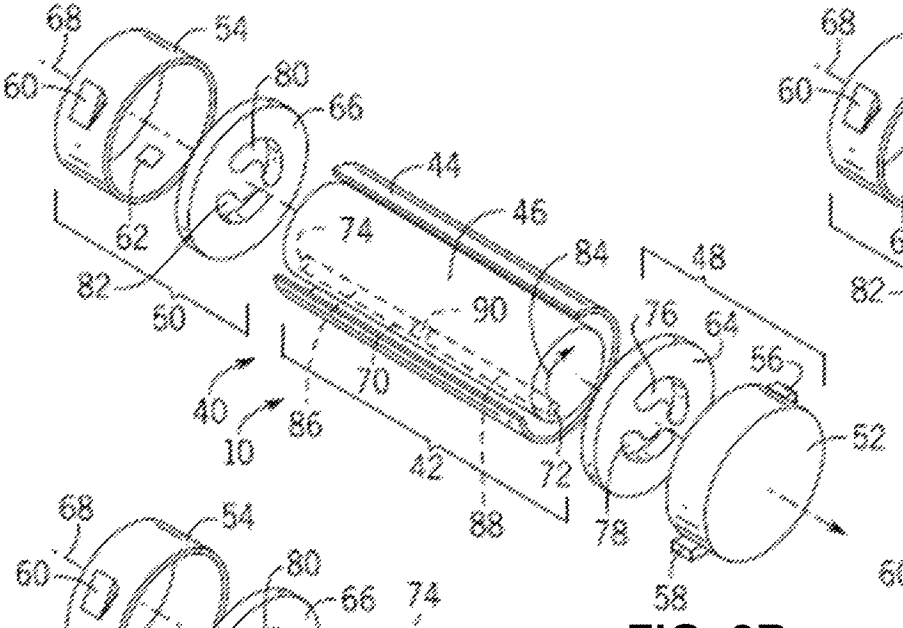

FIG. 2B is an exploded perspective view of an embodiment of a rotary IPX 40 (e.g., rotary LPC), according to certain embodiments. In FIG. 2B, the channel opening 72 is in a first position. In the first position, the channel opening 72 is in fluid communication with the aperture 78 in end cover 64 and therefore with the manifold 52, while the opposing channel opening 74 is in hydraulic communication with the aperture 82 in end cover 66 and by extension with the manifold 54. As will be discussed below, the rotor 46 may rotate in the clockwise direction indicated by arrow 84. In operation, low-pressure second fluid 86 passes through end cover 66 and enters the channel 70, where it contacts the first fluid 88 at a dynamic fluid interface 90. The second fluid 86 then drives the first fluid 88 out of the channel 70, through end cover 64, and out of the rotary IePX 40. However, because of the short duration of contact, there is minimal mixing between the second fluid 86 and the first fluid 88.

Figure 2C:
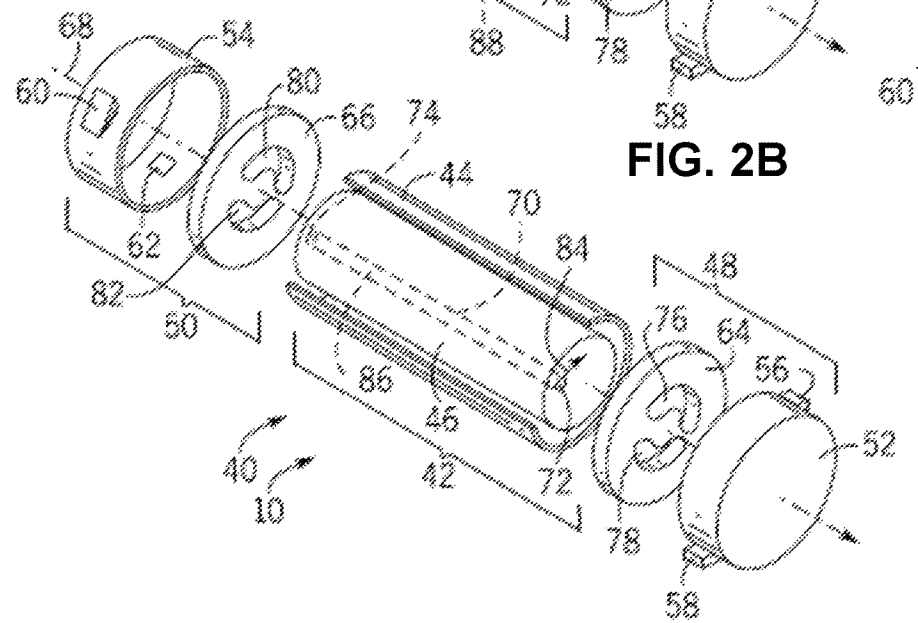

FIG. 2C is an exploded perspective view of an embodiment of a rotary IPX 40 (e.g., rotary LPC), according to certain embodiments. In FIG. 2C, the channel 70 has rotated clockwise through an arc of approximately 90 degrees. In this position, the opening 74 (e.g., outlet) is no longer in fluid communication with the apertures 80 and 82 of end cover 66, and the opening 72 is no longer in fluid communication with the apertures 76 and 78 of end cover 64. Accordingly, the low-pressure second fluid 86 is temporarily contained within the channel 70.

FIG. 2D is an exploded perspective view of an embodiment of a rotary IPX 40 (e.g., rotary LPC), according to certain embodiments. In FIG. 2D, the channel 70 has rotated through approximately 60 degrees of arc from the position shown in FIG. 2B. The opening 74 is now in fluid communication with aperture 80 in end cover 66, and the opening 72 of the channel 70 is now in fluid communication with aperture 76 of the end cover 64. In this position, high-pressure first fluid 88 enters and pressurizes the low-pressure second fluid 86, driving the second fluid 86 out of the rotor channel 70 and through the aperture 80.

FIG. 2E is an exploded perspective view of an embodiment of a rotary IPX 40 (e.g., rotary LPC), according to certain embodiments. In FIG. 2E, the channel 70 has rotated through approximately 270 degrees of arc from the position shown in FIG. 2B. In this position, the opening 74 is no longer in fluid communication with the apertures 80 and 82 of end cover 66, and the opening 72 is no longer in fluid communication with the apertures 76 and 78 of end cover 64. Accordingly, the first fluid 88 is no longer pressurized and is temporarily contained within the channel 70 until the rotor 46 rotates another 90 degrees, starting the cycle over again.

Abrasion and/or erosion damage in an IPX may occur when suspended solids are introduced and mixed in the fluid that enters the IPX. Abrasion damage may occur when particles enter gaps in the IPX (e.g., trapped between a stationary end cover and a rotating end cover). Erosion damage may occur due to existence of suspended solids (e.g., erodents) in high velocity fluid jets (e.g., slurry jets) that are formed due to the high pressure differentials inside the IPX. When the high velocity jet makes an impact with components of the IPX, the high velocity jet can cause damage to those components. Damage (e.g., erosion damage) can occur when a high pressure rotor port (e.g., rotor duct) opens to a low pressure end cover port (e.g., kidney) or when a low pressure rotor port (e.g., rotor duct) opens to a high pressure end cover port (e.g., kidney) which causes a high pressure differential.

Inserts may be resistant to abrasion and/or erosion and may be constructed from a material that has a greater hardness and is tougher than materials of other components of the IPX (e.g., rotor, end cover). The inserts can withstand forces due to abrasion and erosion and can resist high velocity jets (e.g., of slurry) inside the IPX).

To add the inserts (e.g., that are resistant to abrasion and/or erosion), the PX components (e.g., rotor, end covers) are modified and recesses (e.g., pockets) with the shape and size corresponding to the inserts are machined into the components. The inserts are attached to the end cover and/or rotor on the areas that are exposed to abrasion and/or erosion. The inserts can be smaller than IPX rotor ports (e.g., rotor ducts) and cover (e.g., only) the open/close sections of the end cover ports (e.g., kidneys). The inserts can be the same size or larger than IPX rotor ports (e.g., rotor ducts) and cover the entire area between end cover ports (e.g., cover entire sealing area between two kidneys).

The inserts may be attached to the rotor and/or end cover using an epoxied join, a brazed join, a mechanical join, etc.

Inserts may include one or more of carbide, PCD, tungsten carbide, PCD disposed on a carbide substrate, etc. An inserts may be an industrial diamond (e.g., PCD) that is synthesized over a piece of carbide in an autoclave. An insert may be machined into a shape before being brazed inside a pre-machined recess (e.g., pocket) in an end cover or rotor. The end cover or rotor may be tungsten carbide. PCD has an extremely high hardness and can reduce erosion damage by an order of magnitude compared to tungsten carbide. Insert locations are where damage to erosion are most pronounced and aimed at increasing overall life of end covers and rotors. Inserts (e.g., PCDs) may be made as one piece or as multiple pieces to fit together similar to a jigsaw puzzle (e.g., connected to each other with a jigsaw shaped mating face and brazed to the IPX end cover or rotor).

Figures 3A, 3B, 3C, 3D, 3E:
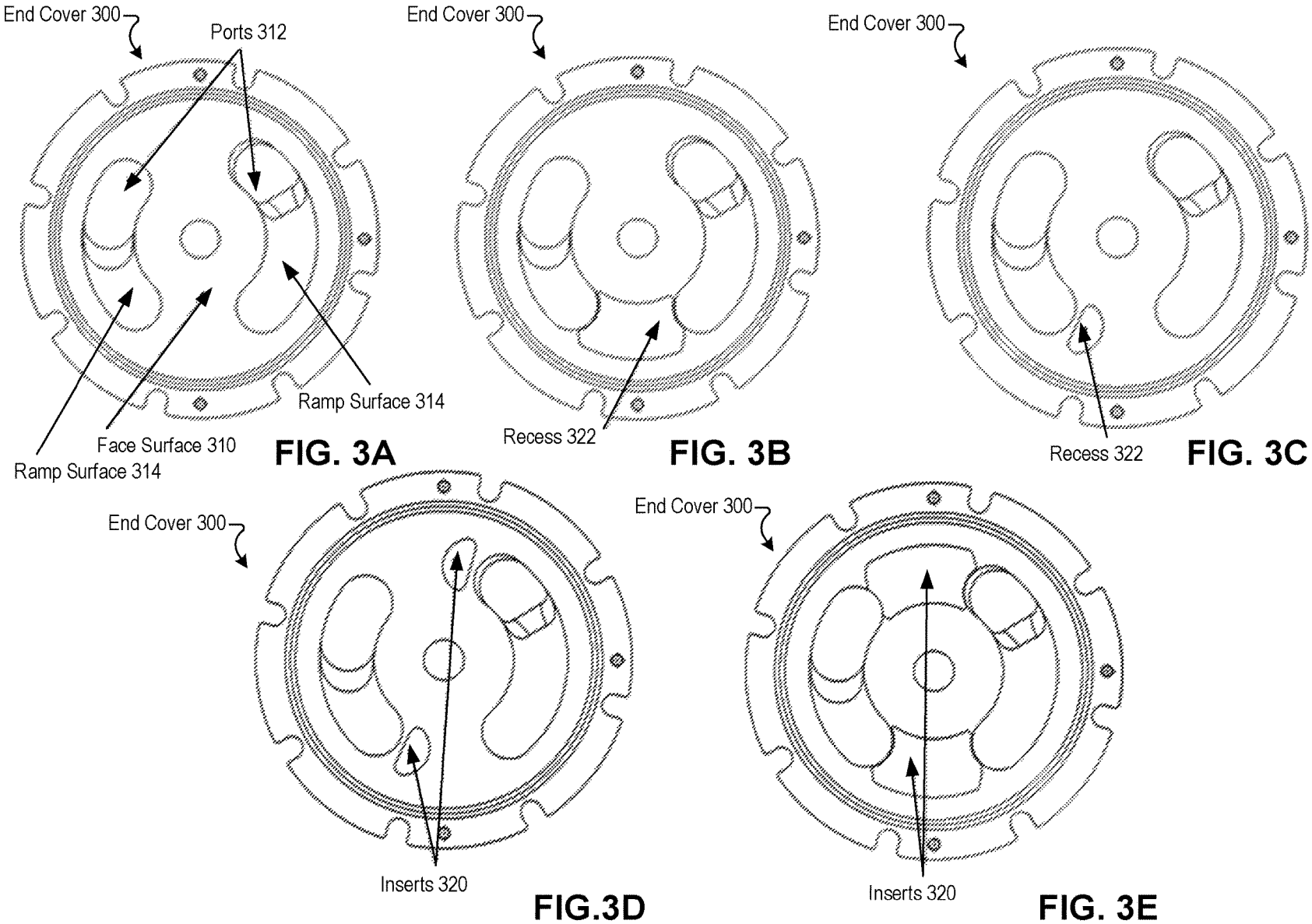
FIGS. 3A-E are front views of end covers of IPXs, according to certain embodiments.

FIGS. 3A-E are front views of end covers 300 of IPXs, according to certain embodiments. FIG. 3A may illustrate an end cover 300 without a recess 322, FIGS. 3B-C may illustrate end covers 300 with recesses 322, and FIGS. 3D-E may illustrate end covers with inserts 320 inserted into the recesses 322. In some embodiments, an outer surface of the insert 320 is substantially flush with the distal end of the rotor and a face surface 310 of the end cover 300. End cover 300 may have a single insert or may have multiple inserts 320. The inserts 320 may be located next to each other or far from each other depending at which locations the abrasion and/or erosion is occurring (e.g., initiating). The recess 322 and insert 320 may be larger (e.g., FIGS. 3B and 3E) or smaller (e.g., FIG. 3C-D).

An end cover 300 may be a cylindrical structure (e.g., an end plate). The end cover 300 may have a circular perimeter that forms notches. The end cover 300 may have upper and lower face surfaces 310 that are substantially planar and parallel to each other. The end cover 300 may have a thickness between the upper and lower face surfaces 310. The end cover 300 may form channels (e.g., inlet channel and outlet channel) between the face surfaces 310. Each channel may have a port 312 formed by the upper face surface 310 and a port 312 formed by the lower face surface 310. In some embodiments, the ports 312 may be kidney-shaped (e.g., long oval that has a concave side and a convex side that are opposite each other and that has rounded ends). Each of the ports 312 may be referred to as a kidney. The end covers 300 may have ramp surfaces 314 (e.g., recesses) that slopes from the port 312 to the face surface 310. The ramp surface 314 and port 312 may together make a c-shape (e.g., substantially equal-distance from the center of the face surface 310 and/or center axis of the end cover 300).

A portion of the face surface 310 between ports 312 may form a recess to receive an insert 320. A first distal end of an insert 320 may be adjacent to a first ramp surface 314 and a second distal end of the insert 320 may be adjacent to a second ramp surface 314 (e.g., FIG. 3B, FIG. 3E). A first distal end of an insert 320 may be adjacent to a first port 312 and a second distal end of the insert 320 may be adjacent to a second port 312 (e.g., FIG. 3E). One or more inserts 320, ports 312, and ramp surfaces 314 may be substantially equal-distant from the center of the face surface 310 (e.g., disposed about a radius from the center of the face surface 310). The inserts 320, ports 312, and/or ramp surfaces 314 may substantially align with the rotor ports of the rotor. Inserts 320 may be disposed at locations of one or more of high erosion, high abrasion, high pressure, high failure, etc.

In some embodiments, an insert 320 is disposed between ports 312 without being adjacent to the two ports 312 and/or the two ramp surfaces 314 (e.g., FIGS. 3C-D). The inserts 320 may be located at the locations of one or more of highest erosion, highest abrasion, highest pressure, highest failure, etc. An insert 320 may be kidney-shaped, rectangular, triangular, circular, oval-shaped, elliptical, etc. In some embodiments, an insert is disposed proximate a ramp surface 314. In some examples, an insert is disposed proximate a port 312. In some embodiments, an end cover 300 has a first port 312 proximate a first ramp surface 314 that is proximate a first insert 320 and the end cover 300 has a second ramp surface that is proximate a second port 312 that is proximate a second insert 320.

In some embodiments, the rotor rotates (e.g., clockwise, counter-clockwise) relative to the face surface 310 so that the high pressure stream of fluid hits the end cover 300 at the location of the insert 320 and then enters the ramp surface 314 and/or port 312.

Figure 4B:
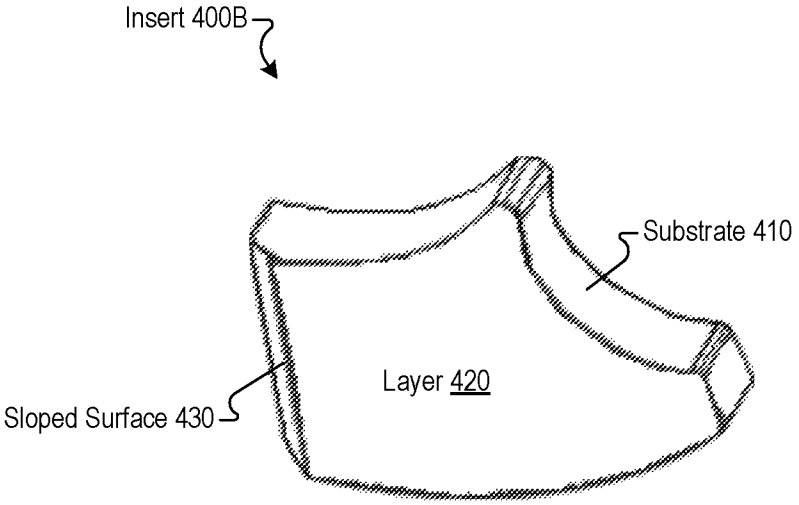
FIGS. 4A-B illustrate inserts of IPXs, according to certain embodiments.
Figure 4A:
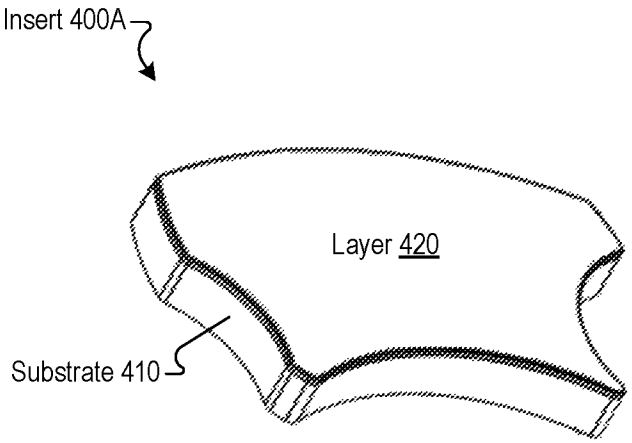

FIGS. 4A-B illustrate inserts 400A-B (e.g., insert 320) of IPXs, according to certain embodiments. Inserts 400A-B may have a substrate 410 (e.g., tungsten carbide substrate) and a layer 420 (e.g., PCD layer) on the substrate 410. An upper surface and a lower surface of each insert 400A-B may be substantially planar and substantially parallel. The sidewalls of the inserts 400A-B may be substantially perpendicular to the upper surface and the lower surface of each of the insert 400A-B. Insert 400A may have a first distal end proximate a first ramp surface 314 and a second distal end proximate a second ramp surface 314. Insert 400B may have a first distal end proximate a first port 312 and a second distal end proximate a second port 312. Insert 400B may have a sloped surface 430 (e.g., at about 60 degree angle) from an upper surface of the insert 400B to a sidewall of the insert 400B.

The inserts 400 may be resistant to abrasion and/or erosion and may be made of a hard material (e.g., hardness of insert 400 may be greater than the hardness of the base material of the end cover and/or rotor). The inserts 400 may be made from tungsten carbide, PCD, or other hard materials. In some embodiments, the insert 400 is made out of a disc that has a layer of PCD deposited on a carbide substrate. The disc is cut into the shape and size through electrical discharge machining (EDM). After the insert 400 is cut, the insert 400 is fixed into the recess formed by the end cover or rotor. In some embodiments, the inserts 400 are attached to the end cover and/or rotor of the IPX using an epoxy or a brazing method.

Figures 5A, 5B, 5C, 5D:
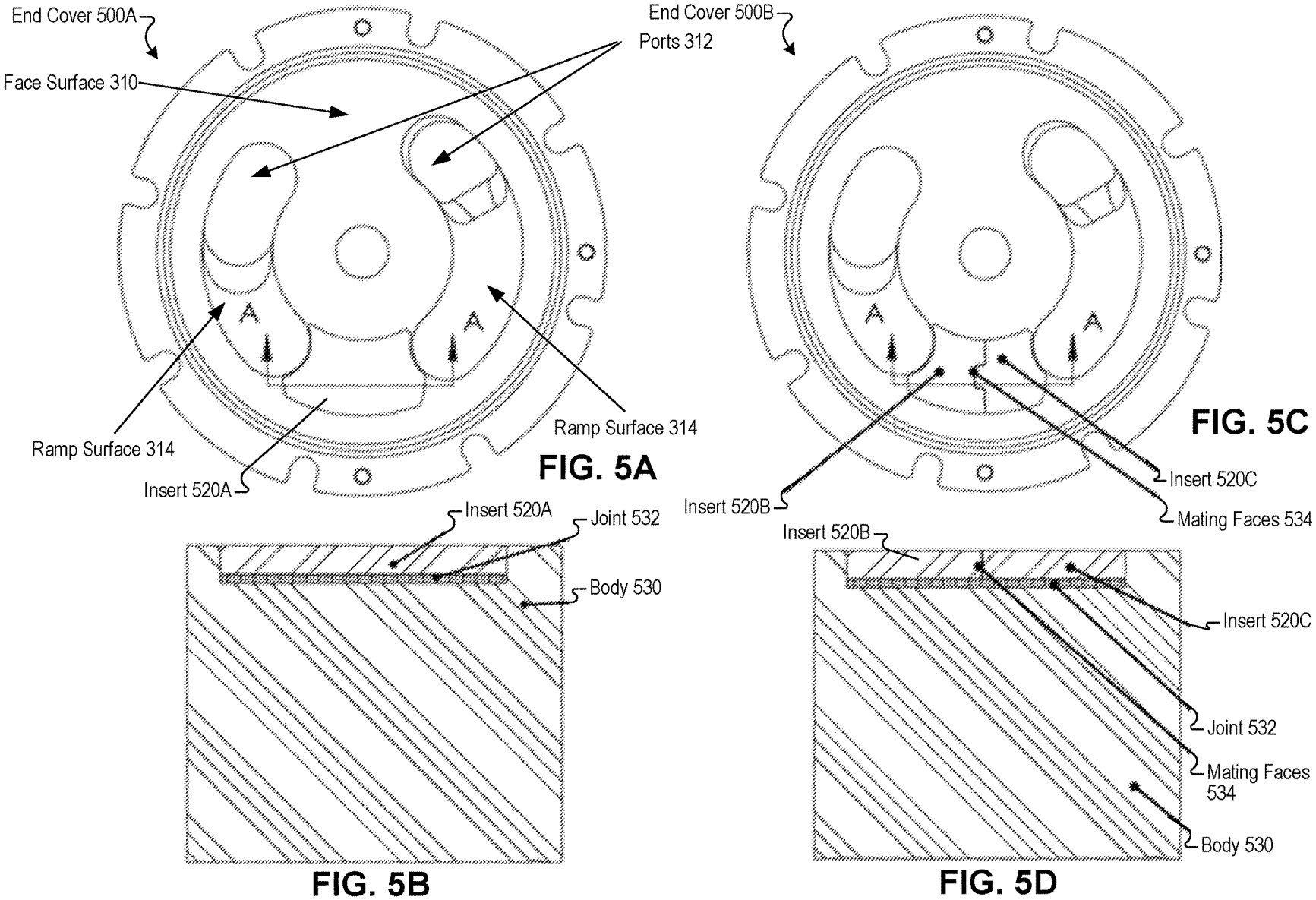
FIGS. 5A-D illustrate inserts of IPXs, according to certain embodiments.

FIGS. 5A-D illustrate inserts 520 (e.g., inserts 320 of FIGS. 3A-E, inserts 400A-B of FIGS. 4A-B) of end covers 500A-B of IPXs, according to certain embodiments. FIGS. 5A and 5C illustrate front views. FIG. 5B illustrates a cross-sectional view (e.g., along section line A-A) of FIG. 5A. FIG. 5D illustrates a cross-sectional view (e.g., along section line A-A) of FIG. 5C.

End covers 500A-B have face surfaces 310 that form ramp surfaces 314 and ports 312. One or more inserts 520 are disposed between ports 312 (e.g., between ramp surfaces 314). The body 530 of the end cover 500 may form a recess. The one or more inserts 520 may be disposed in the recess and connected to body 530 via a joint 532. The joint may be a braze or epoxy joint.

Referring to FIG. 5A, the insert 520 may be a single insert 520A disposed in the recess formed by the body 530 of the end cover 500A.

Inserts may include multiple pieces positioned next to each other. Referring to FIG. 5B, multiple inserts 520B-C may be disposed in the recess formed by the body 530 of the end cover 500B. The inserts 520B-C may have a mating faces 534 that are proximate each other. In some embodiments, the mating faces 534 are straight walls with a small gap that provides the ability for the inserts 520B-C to have small movement independently without affecting each other. In some embodiments, the mating faces 534 are jigsaw-shaped (e.g., one mating face 534 is a sidewall that forms a recess and one mating face 534 is a sidewall that forms a protrusion that substantially matches the recess). The jigsaw shape may provide a locking mechanism between inserts 520B-C and allows alignment during assembly.

Figure 6B:
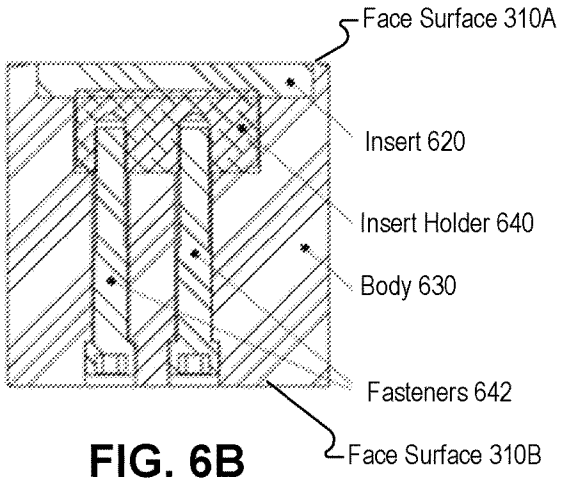
FIGS. 6A-D illustrate views of an insert attached to an end cover of an IPX, according to certain embodiments.
Figure 6A:
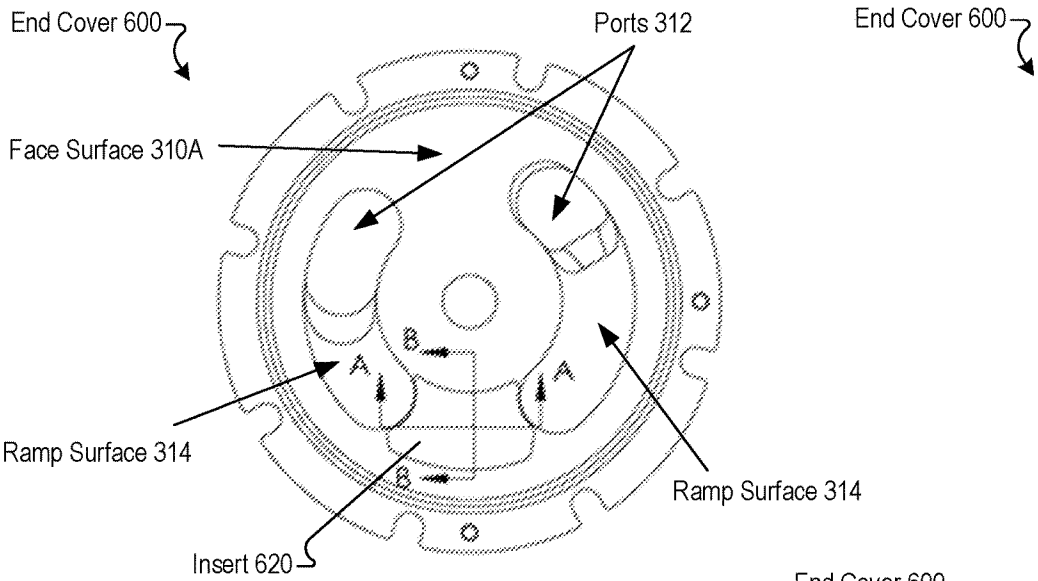
Figure 6D:
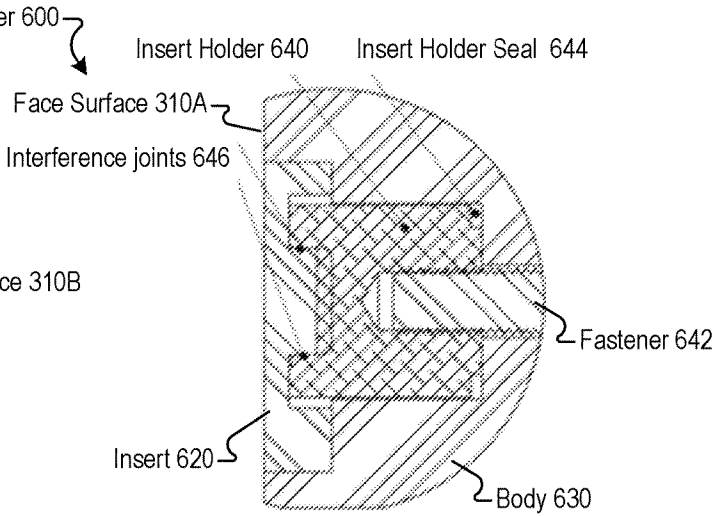
Figure 6C:
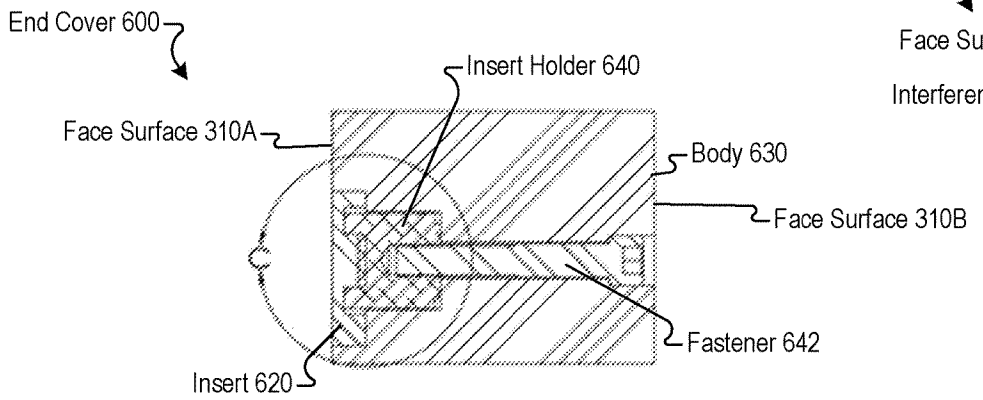

FIGS. 6A-D illustrate views of an insert 620 (e.g., inserts 320 of FIGS. 3A-E, inserts 400A-B of FIGS. 4A-B, inserts 520 of FIGS. 5A-D) attached to an end cover 600 of an IPX, according to certain embodiments. FIG. 6A is a front view of an end cover 600. FIG. 6B is a cross-sectional view (e.g., along cut-lines A-A) of end cover 600. FIG. 6C is a cross-sectional view (e.g., along cut-lines B-B) of end cover 600. FIG. 6C is a cross-sectional enlarged view (e.g., of detail C of FIG. FIG. 6C) of end cover 600.

In some embodiments, inserts 620 are fixed to the end cover 600 using one or more fasteners 642 (e.g., mechanical attachment method) with specific bolt torque to handle pressure loads during operation. An insert 620 may be fixed into an insert holder 640 with an interference fit (e.g., interference joints 646). In some embodiments, an insert holder 640 is configured to secure to the insert 620 via an interference fit and the insert holder 640 is configured to removably attach to the body 630 of the end cover 600 via one or more fasteners 642. The amount of interference between the insert 620 and the holder 640 may be adjusted to allow no separation under loads at operating conditions. The insert holder 640 may have one or more tapped holes used for attaching the insert holder 640 to the end cover 600. One or more fasteners 642 (e.g., tension bolts) are threaded into the insert holder 640 through the end cover 600. The insert holder 640 may have a small seal (e.g., insert holder seal 644, gasket, O-ring, etc.) to provide sealing across the assembly.

End cover 600 has face surfaces 310 that form ramp surfaces 314 and ports 312. One or more inserts 620 are disposed between ports 312 (e.g., between ramp surfaces 314). The body 630 of the end cover 600 may form a recess on an upper face surface 310A and one or more recesses on the lower face surface 310B. A channel may pass through the body 630 of the end cover 600 from the recess formed by the face surface 310A to each of the recesses formed by the face surface 310B. An insert holder 640 may be disposed in the recess formed by the face surface 310A. A fastener 642 may be routed through each channel from the recess formed in the face surface 310B to connect to the insert holder 640. The recess in the face surface 310B may be sized to receive a head of a fastener 642 and the channel may be sized to receive the body of the fastener 642. An insert holder seal 644 (e.g., gasket, O-ring, etc.) may be disposed between a lower surface of the insert holder 640 and the body 630 of the end cover 600 that forms the recess. Insert 620 may be coupled to the insert holder 640 via one or more interference joints 646. The recess formed by the face surface 310A may be a stepped recess, where a deeper portion of the recess has a smaller width to receive the insert holder 640 and a shallower portion of the recess has a larger width to receive the insert 620 (e.g., insert 620 is wider than the insert holder 640).

Figure 7B:
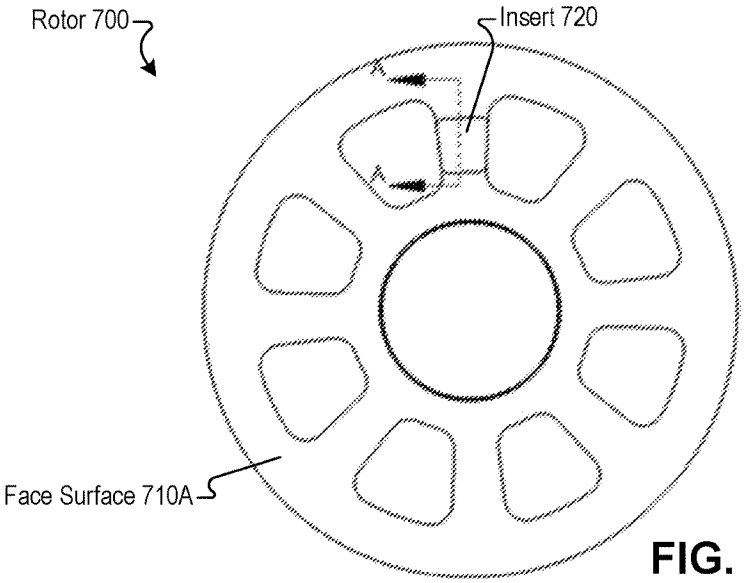
FIGS. 7A-C illustrate rotors of an IPX, according to certain embodiments.
Figure 7A:
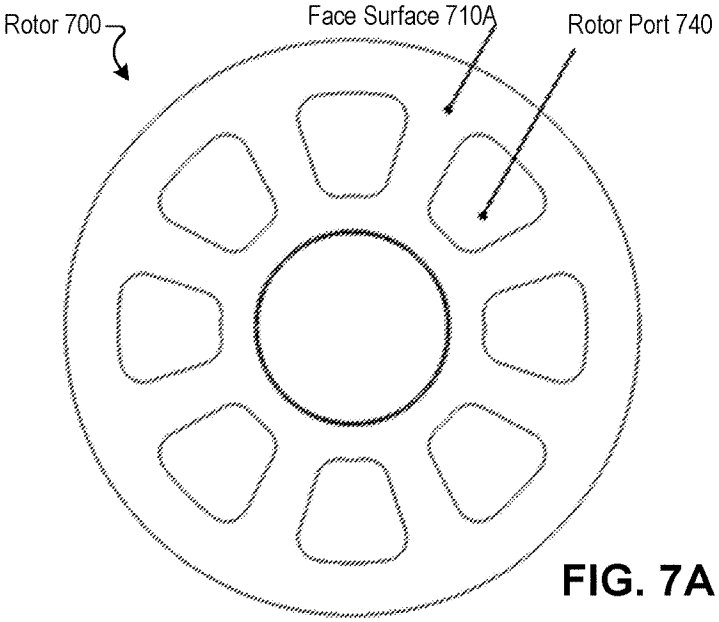
Figure 7C:
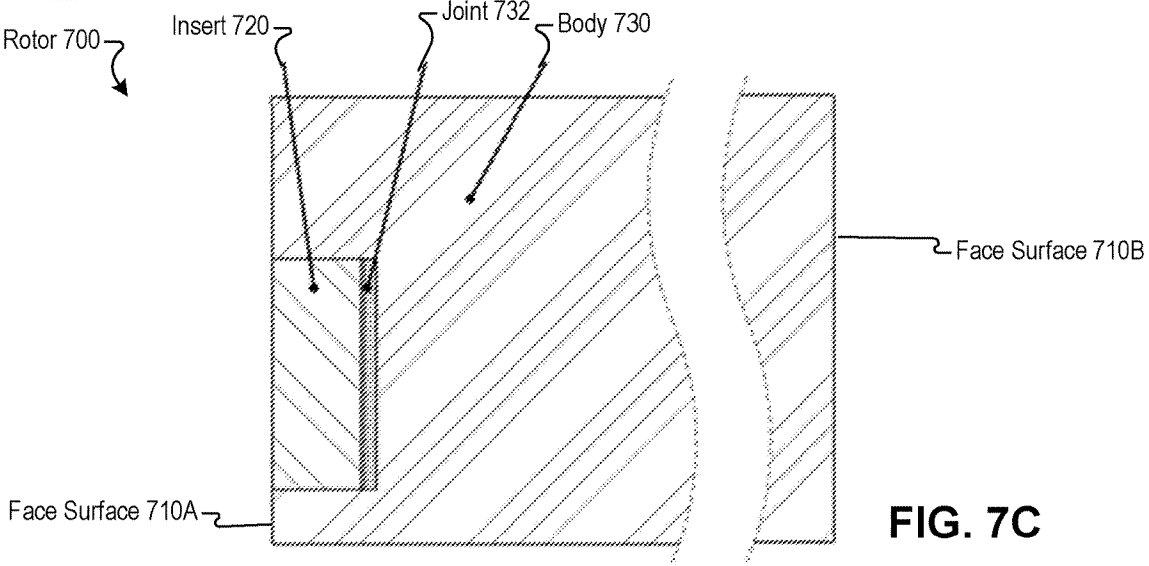

FIGS. 7A-C illustrate rotors 700 of an IPX, according to certain embodiments. Features of inserts described herein with respect to end covers may also apply to inserts of rotors 700.

Rotor 700 has an upper face surface 710A and a lower face surface 710B. The face surfaces 710A-B form ports (e.g., rotor ports) that are connected via rotor ducts (e.g., channels through the body 730 of the rotor 700).

The rotor 700 includes one or more inserts 720 located between rotor ports 740. The face surface 710A may form a recess between rotor ports 740 and an insert 720 may be disposed in the recess. A joint 732 (e.g., epoxy joint, braze joint) may connect the insert 720 to the body 730 in the recess.

Inserts 720 that are resistant to abrasion and/or erosion may be added to the rotor 700 between rotor ports 740 (e.g., between rotor ducts). The area between two rotor ports 740 (e.g., between two rotor ducts, duct wall) is a sealing area on the rotor 700. Any damage to this area (e.g., erosion and/or abrasion damage) may result in reduction in IPX efficiency or a failure. A rotor 700 can have one or more inserts 720.

The preceding description sets forth numerous specific details, such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or." When the term "about," "substantially," or "approximately" is used herein, this is intended to mean that the nominal value presented is precise within ±10%. Also, the terms "first," "second," "third," "fourth," etc. as used herein are meant as labels to distinguish among different elements and can not necessarily have an ordinal meaning according to their numerical designation.

The terms "over," "under," "between," "disposed on," and "on" as used herein refer to a relative position of one material layer or component with respect to other layers or components. For example, one layer disposed on, over, or under another layer may be directly in contact with the other layer or may have one or more intervening layers. Moreover, one layer disposed between two layers may be directly in contact with the two layers or may have one or more intervening layers. Similarly, unless explicitly stated otherwise, one feature disposed between two features may be in direct contact with the adjacent features or may have one or more intervening layers.

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner. In one embodiment, multiple metal bonding operations are performed as a single step.

It is to be understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which each claim is entitled.

What is claimed is:

1. A system comprising:

an isobaric pressure exchanger (IPX) configured to exchange pressure between a first fluid and a second fluid, the IPX comprising:

a rotor configured to rotate about a longitudinal axis of the rotor, the rotor forming a plurality of rotor ports arranged substantially symmetrically around the longitudinal axis at a distal end of the rotor;

an end cover configured to be disposed at the distal end of the rotor, the end cover forming a plurality of end cover ports, wherein the plurality of rotor ports are arranged for hydraulic communication with the plurality of end cover ports; and an insert disposed between two of the plurality of rotor ports or between two of the plurality of end cover ports, wherein the insert contacts two flow channels formed by the two of the plurality of rotor ports or the two of the plurality of end cover ports.

2. The system of claim 1, wherein:

the plurality of end cover ports comprise an inlet port and an outlet port that are substantially equal-distant from a center axis of the end cover;

the insert is disposed between a first distal end of the inlet port and a first distal end of the outlet port; and a second insert is disposed between a second distal end of the inlet port and a second distal end of the outlet port.

3. The system of claim 1, wherein the insert comprises one or more of tungsten carbide or polycrystalline diamond (PCD).

4. The system of claim 1, wherein the insert comprises a layer of PCD disposed on a carbide substrate.

5. The system of claim 1, wherein the rotor or the end cover forms a recess between corresponding ports to receive the insert, and wherein an outer surface of the insert is substantially flush with the distal end of the rotor and a surface of the end cover.

6. The system of claim 5, wherein the insert is attached to the rotor or the end cover at the recess via epoxy or brazing.

7. The system of claim 1, wherein the insert comprises a first component that has a first mating face and a second component that has a second mating face, wherein the first component and the second component are configured to align via the first mating face and the second mating face.

8. The system of claim 1, wherein the insert is removably attached to the rotor or the end cover via one or more fasteners.

9. The system of claim 1 further comprising an insert holder configured to secure to the insert via an interference fit, wherein the insert holder is configured to attach to the rotor or the end cover via one or more fasteners.

10. A rotor of an isobaric pressure exchanger (IPX) that is configured to exchange pressure between a first fluid and a second fluid, the rotor comprising:

a distal end forming a plurality of rotor ports arranged for hydraulic communication with a plurality of end cover ports of an end cover of the IPX, wherein the plurality of rotor ports are arranged substantially symmetrically around a longitudinal axis of the rotor, and wherein the rotor is configured to rotate about the longitudinal axis within the IPX; and an insert disposed in a recess formed by the distal end of the rotor between two of the plurality of rotor ports, wherein the insert contacts two flow channels formed by the two of the plurality of rotor ports.

11. The rotor of claim 10, wherein the insert comprises one or more of:

tungsten carbide;

polycrystalline diamond (PCD); or a layer of PCD disposed on a carbide substrate.

12. The rotor of claim 10, wherein an outer surface of the insert is substantially flush with the distal end of the rotor and a face surface of the end cover, and wherein the insert is attached to the rotor at the recess via epoxy or brazing.

13. The rotor of claim 10, wherein the insert comprises a first component that has a first mating face and a second component that has a second mating face, wherein the first component and the second component are configured to align via the first mating face and the second mating face.

14. The rotor of claim 10 further comprising an insert holder configured to secure to the insert via an interference fit, wherein the insert holder is configured to removably attach to the rotor via one or more fasteners.

15. An end cover of an isobaric pressure exchanger (IPX) that is configured to exchange pressure between a first fluid and a second fluid, the end cover comprising:

a face surface forming an inlet port and an outlet port arranged for hydraulic communication with a plurality of rotor ports of a rotor of the IPX, wherein the inlet port and the outlet port are arranged substantially symmetrically around a center axis of the end cover; and an insert disposed in a recess formed by the face surface of the end cover between the inlet port and the outlet port, wherein the insert contacts an inlet flow channel formed by the inlet port and an outlet flow channel formed by the outlet port.

16. The end cover of claim 15, wherein:

the insert is disposed between a first distal end of the inlet port and a first distal end of the outlet port; and a second insert is disposed between a second distal end of the inlet port and a second distal end of the outlet port.

17. The end cover of claim 15, wherein the insert comprises one or more of:

tungsten carbide;

polycrystalline diamond (PCD); or a layer of PCD disposed on a carbide substrate.

18. The end cover of claim 15, wherein an outer surface of the insert is substantially flush with a distal end of the rotor and the face surface, and wherein the insert is attached to the end cover at the recess via epoxy or brazing.

19. The end cover of claim 15, wherein the insert comprises a first component that has a first mating face and a second component that has a second mating face, wherein the first component and the second component are configured to align via the first mating face and the second mating meting face.

20. The end cover of claim 15 further comprising an insert holder configured to secure to the insert via an interference fit, wherein the insert holder is configured to removably attach to the end cover via one or more fasteners.

* * * * *